US010844574B2

(12) United States Patent
Bural et al.

(10) Patent No.: US 10,844,574 B2
(45) Date of Patent: Nov. 24, 2020

(54) MOBILE VACUUM SYSTEM

(71) Applicant: The Charles Machine Works, Inc., Perry, OK (US)

(72) Inventors: David A. Bural, Edmond, OK (US); Levi J. Krutzfeldt, Perry, OK (US); L. Shane Ingram, Perry, OK (US); Vernon T. Stellman, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 246 days.

(21) Appl. No.: 15/977,282

(22) Filed: May 11, 2018

(65) Prior Publication Data

US 2018/0327999 A1 Nov. 15, 2018

Related U.S. Application Data

(60) Provisional application No. 62/505,415, filed on May 12, 2017.

(51) Int. Cl.
*B08B 9/08* (2006.01)
*E02F 3/88* (2006.01)

(52) U.S. Cl.
CPC ..... *E02F 3/8816* (2013.01); *B08B 9/08* (2013.01)

(58) Field of Classification Search
CPC ..... A47L 9/22; A47L 5/28; A47L 5/24; A47L 9/00; A47L 7/04; A47L 7/0014; A47L 7/0019; A47L 7/0023; A47L 7/0028; A47L 7/0038; E02F 3/8816; E02F 3/88; B08B 9/08; B08B 9/0821; B08B 9/00; B08B 9/02; B08B 9/021; B08B 9/035; B08B 9/047; B08B 9/051
See application file for complete search history.

(56) References Cited

U.S. PATENT DOCUMENTS 1,618,667 A * 2/1927 Melcher ..... A47L 5/38 200/61.6
3,621,893 A * 11/1971 Nishimura ..... B60P 1/60 141/65
4,227,893 A * 10/1980 Shaddock ..... B60P 1/60 15/340.1
5,996,171 A * 12/1999 Bowers ..... B01D 46/002 15/340.1
7,837,050 B2 11/2010 Maybury, Jr.
(Continued)

OTHER PUBLICATIONS

Photos taken at various trade shows prior to May 12, 2017.
(Continued)

*Primary Examiner* — Robert J. Scruggs
(74) *Attorney, Agent, or Firm* — Tominson McKinstry, P.C.

(57) ABSTRACT

A system for controlling pressure to a vacuum tank. The system comprises a conduit disposed between the vacuum tank and a blower. The conduit has a sealable connection disposed along its length between two sections that are geometrically conforming. The connection may be conical and threadless. Tilting the vacuum tank relative to the blower causes the connection to separate, allowing pressure within the vacuum tank to equalize with atmospheric pressure. Filters may be provided on each side of the connection for removing particulates from air evacuated from the tank.

18 Claims, 9 Drawing Sheets

(56) References Cited

U.S. PATENT DOCUMENTS

| | | | | |
|---|---|---|---|---|
| 8,360,260 | B2 | 1/2013 | Maybury, Jr. | |
| 8,925,753 | B2 | 1/2015 | Maybury, Jr. | |
| 9,057,180 | B1 | 6/2015 | Sewell | |
| 9,260,048 | B2 | 2/2016 | Maybury, Jr. | |
| 9,260,049 | B2 | 2/2016 | Maybury, Jr. | |
| 9,260,050 | B2 | 2/2016 | Maybury, Jr. | |
| 9,821,953 | B2 | 11/2017 | Sewell et al. | |
| 2016/0153168 | A1 | 6/2016 | Maybury, Jr. | |
| 2016/0244941 | A1* | 8/2016 | Naud | E02F 3/90 |
| 2017/0292306 | A1 | 10/2017 | Sewell | |
| 2018/0072493 | A1 | 3/2018 | Sewell et al. | |

OTHER PUBLICATIONS

United States Patent and Trademark Office, "Office Action Summary", dated Nov. 1, 2016, U.S. Appl. No. 14/737,240, 20 pages, Alexandria, VA.

United States Patent and Trademark Office, "Office Action Summary", dated May 2, 2017, U.S. Appl. No. 14/737,240, 12 pages, Alexandria, VA.

* cited by examiner

MOBILE VACUUM SYSTEM

FIELD

The invention is directed generally to vacuum systems used for the collection and removal of debris in various applications, including drilling and excavation operations.

SUMMARY

The present invention is directed to a vacuum assembly. The assembly comprises a vacuum tank, a blower, a first and second filtration assembly, and a conduit. The blower is configured to remove air from the vacuum tank. The first filtration assembly is connected to the vacuum tank. The second filtration assembly is connected to the blower and the first filtration assembly. The conduit extends between the first and second filtration assemblies. The conduit comprises a first pipe section and a second pipe section, each having an end. The end of the second pipe section is sized to be closely received within the first pipe section's end and removably joined in threadless connection.

The invention is also directed to a vacuum system. The system comprises a blower, a tank, a conduit, and an actuator. The conduit is disposed between the tank and the blower. Operation of the blower evacuates air from the tank through the conduit. The conduit comprises a first section and a second section. The first section is attached to the tank and has an end characterized by a conical frustum. The second section is attached to the blower and has an end complementary to the end of the first section. The actuator moves the tank and first section between a first position and a second position relative to the blower and the second section. The first position is characterized by the end of the first section and the end of the second section being joined in threadless connection. The second position is characterized by the end of the first section and the end of the second section being separated such that the blower and the tank are not in communication through the conduit.

DETAILED DESCRIPTION

Figure 1:
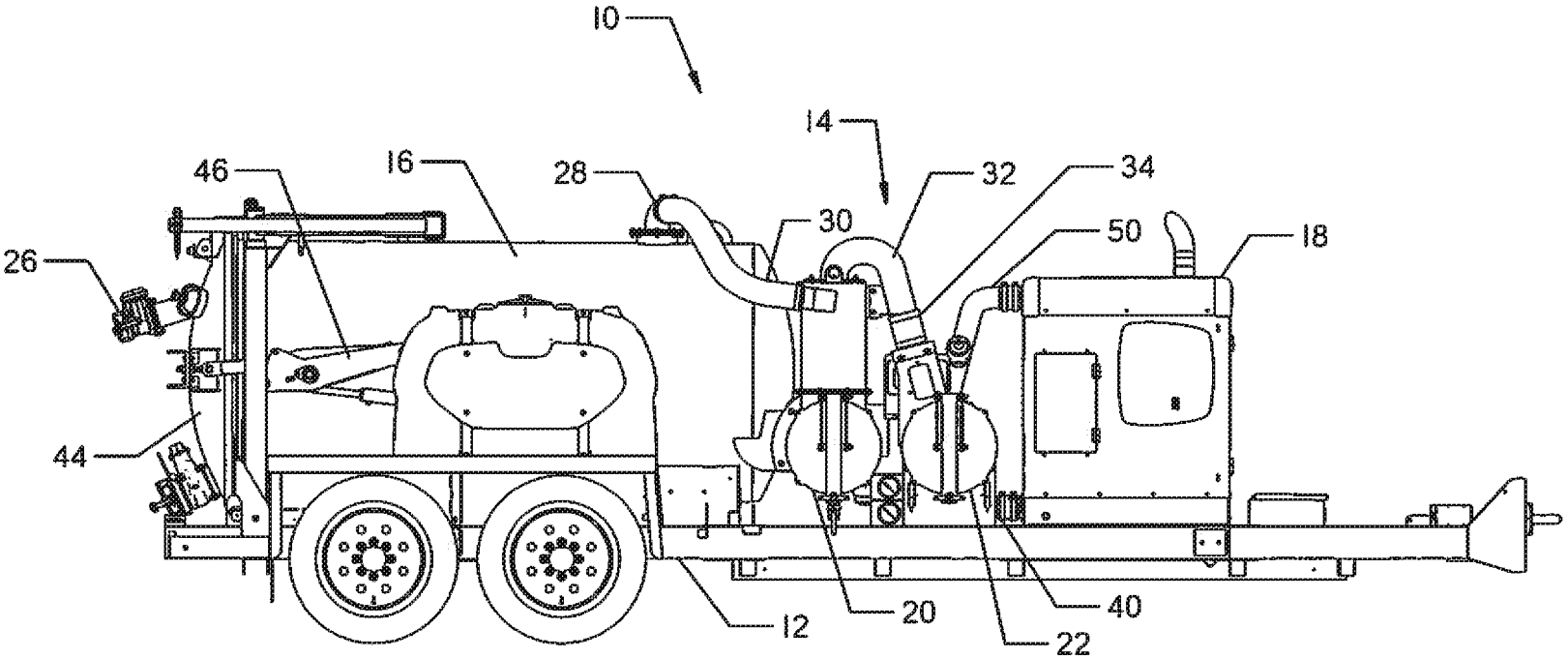
FIG. 1 is a side view of a vacuum assembly disposed on a trailer.
Figure 2:
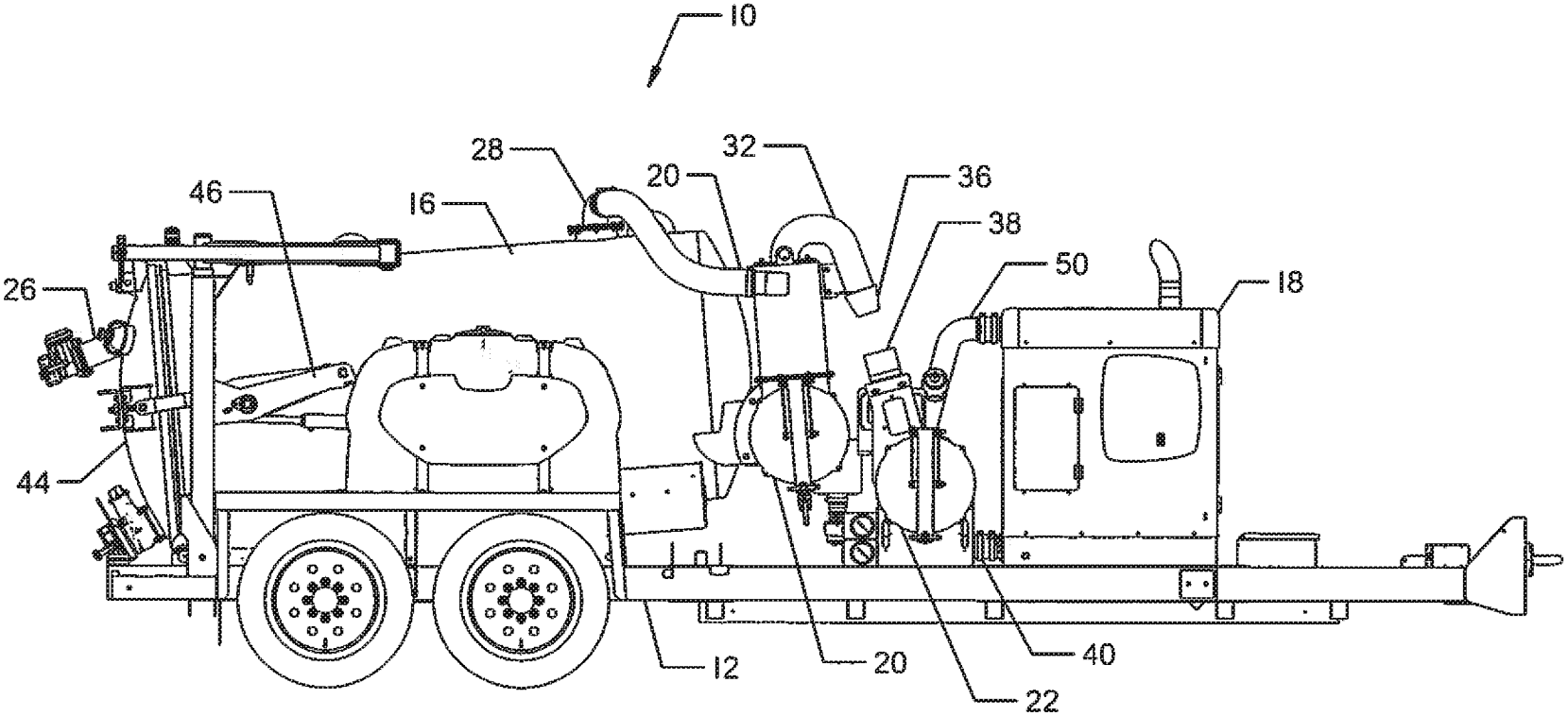
FIG. 2 is a side view of the vacuum assembly of FIG. 1 with a separated air conduit.

This invention relates generally to mobile vacuum systems such as system shown in FIGS. 1 and 2. Such vacuum systems to are utilized to excavate spoils, or dirt and mud, from an excavation site during excavation activities. During the vacuuming process, a pump or blower pulls air out of a vacuum tank. The vacuum tank therefore is maintained at a lower pressure than the atmosphere, or vacuum pressure. A hose or wand can then be extended from the vacuum tank to the excavation site to pull material into the tank.

A sealed vacuum tank does not need to be maintained at a vacuum pressure when not in use. When the pump or blower is turned off, air flow rapidly reverses direction toward the area of low pressure in the tank. Rapidly reversing the air flow can harm components of the system. For example, high flow may cause the pump or blower, and thus the engine powering it, to rotate backwards. If the pressure in the engine assembly is relieved slowly, then the components are not turned by the flow of air.

While slow release of pressure may be beneficial for the engine assembly, an operator may want to quickly release pressure from the vacuum tank so that the tank door can be easily opened to empty and clean out the tank. When a vacuum pressure is maintained inside a tank, the opening force required to open the door is increased. A quick mechanism to equalize the pressure between the tank and the atmosphere without causing reverse flow in the pump is advantageous. Thus, new tools and methods are needed for controlling the release of pressure in vacuum systems.

Shown in FIG. 1 is a mobile vacuum system 10 having a trailer 12 and a vacuum assembly 14. While a trailer 12 is shown for convenience, it should be understood that vacuum assemblies 14 may be alternatively placed on dedicated vehicles. The vacuum assembly 14 comprises a vacuum tank 16, an engine assembly 18, and a filtration assembly comprising a first filter 20 and a second filter 22. The vacuum tank 16 has a door 44, a tank inlet 26 and a tank outlet 18. A suction hose (not shown) may be connected to the inlet 26 and used to remove spoils from an excavation area to the vacuum tank 16.

The engine assembly 18 comprises a pump that evacuates air from the vacuum tank 16 by pulling air through the tank outlet 28. This evacuation of air induces a vacuum pressure within the tank 16, allowing debris to be pulled into the tank inlet 26 through the suction hose. The bulk of the debris is deposited in the tank 16.

The evacuated air enters a first conduit 30. The first conduit 30 is disposed between the tank outlet 28 and the first filter 20. The first conduit 30 may be a sealed elastomeric hose or other appropriate structure. The first filter 20 removes fine debris from air passing through the first conduit 30.

A second conduit 32 is disposed between the first filter 20 and second filter 22. The second conduit 32 is preferably separable at a connection point 34. A third conduit 40 is disposed between the second filter 22 and the engine assembly 18. The second filter 22 removes additional fine debris from air passing through the second conduit 32.

The first filter 20 and second filter 22 may be cyclones, filters, or other known devices for removing particulates from an air stream. Alternatively, only one filter may be utilized in the vacuum system 14.

Figure 3A:
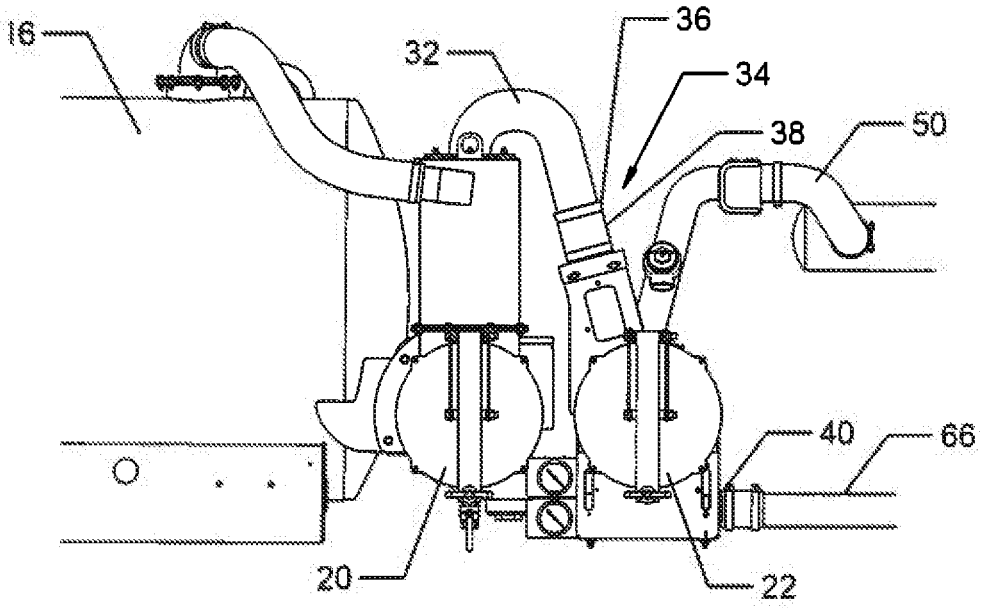
FIG. 3A is a cutaway side view of a conduit in a made up position.
Figure 3B:
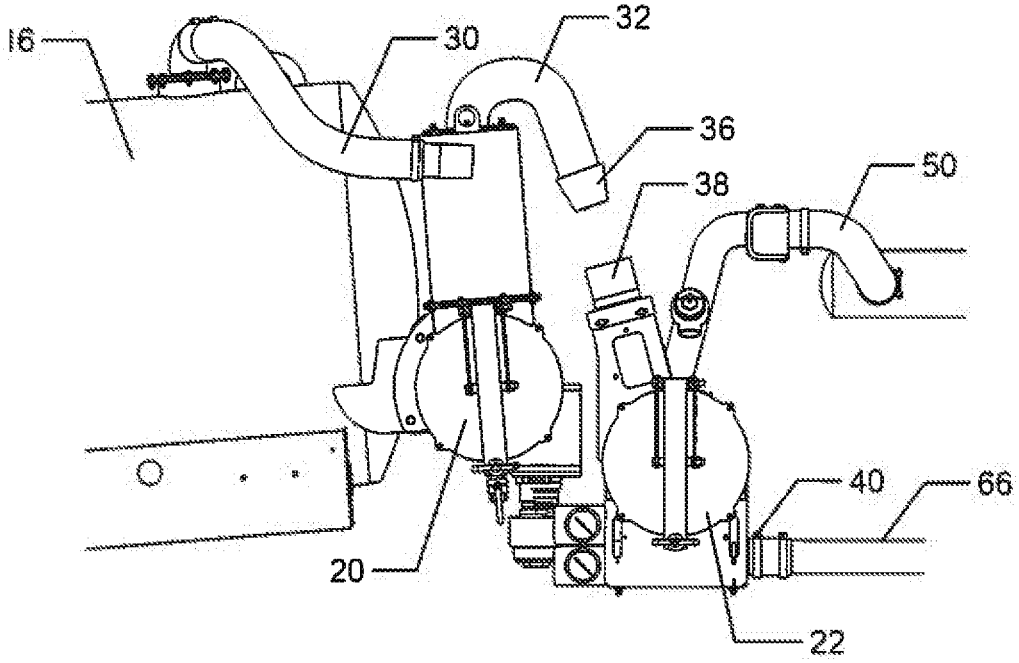
FIG. 3B is a cutaway side view of the conduit in a separated position.

As shown in FIG. 2, and in more detail at FIGS. 3A-3B, the connection point 34 may be a position in which two ends of the conduit sections separate and join. A male end 36 is characterized by the shape of a conical frustum. A female end 38 is complementary to the first end 36. As shown, the female end 38 is disposed on the side of the connection point 34 nearest the second filter 22. The male end 36 is disposed nearest the first filter 20. However, these positions may be reversed without departing from the spirit of the invention.

As shown in FIGS. 2 and 3A, the tank 16, first filter 20, first conduit 30 and the second conduit 32 between the connection point 34 and first filter may be moved relative to the trailer 12. This movement causes the ends 36, 38 to separate. Therefore, the pressure of the vacuum tank 16 is rapidly equalized to the atmosphere without air travelling through the engine assembly 18 in the incorrect direction. The vacuum tank 16 comprises a door 44 which may be raised and lowered by an arm assembly 46. After the connection point 34 is separated, the door 44 may be opened by the arm assembly 46 and the tank evacuated and/or cleaned.

Therefore, the connection point 34 and the vacuum assembly 14 are movable between a first position and a second position. In the first position, the connection point is made up and air may move throughout the entire system. In the second position, the ends 36, 38 are separate and air is allowed to enter the tank from the environment. Preferably, a seal is located within end 38 and/or about end 36 to prevent air from leaking when in the first position. This may be an elastomeric seal.

While a conical, threadless connection between ends 36, 38 is advantageous to quick easy connection and near-instantaneous separation, other shapes may be utilized. For example, the ends may be complementary pyramids or may comprise splines.

Figure 4:
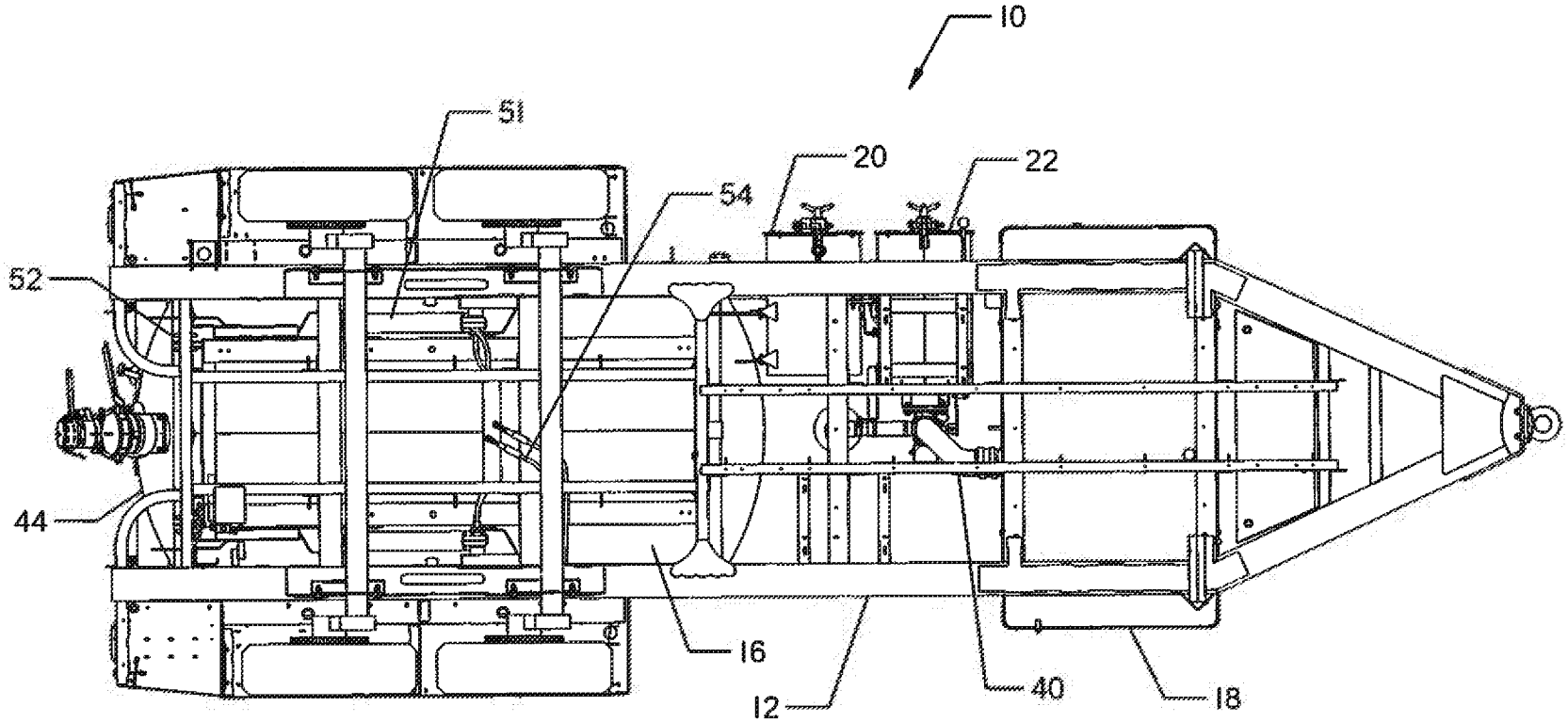
FIG. 4 is a bottom view of the vacuum assembly of FIG. 1.

With reference to FIG. 4, the underside of the mobile vacuum system to is shown. An actuator 51 extends between the vacuum tank 16 and the trailer 12, causing the vacuum tank 16 to pivot relative to the trailer 12, engine assembly 18, and second filtration assembly 22 about pivot point 52. As shown, the actuator 51 consists of two hydraulic cylinders, powered through hydraulic lines 54.

After filtration, the air passes through the engine assembly 18 to an exhaust 50 where it may be vented to the air.

Figure 5:
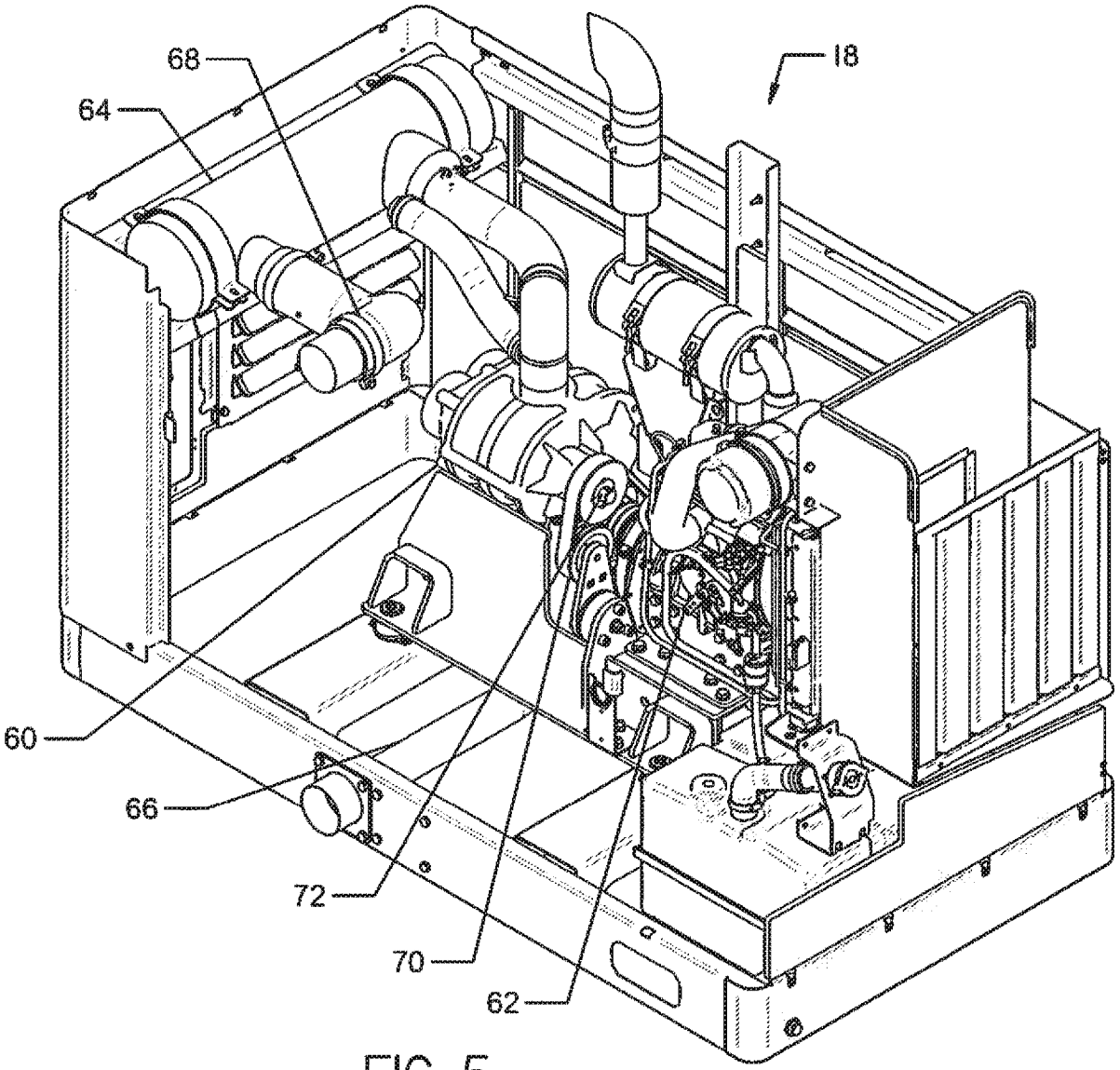
FIG. 5 is a partially cut-away perspective view showing internal components of an engine assembly for use with the vacuum assembly of FIG. 1.

With reference to FIG. 5, the engine assembly 18 is shown in more detail. The engine assembly 18 comprises a blower 60, a power source 62, a silencer 64, an inlet duct 66 and an outlet duct 68. The blower 60 may be a positive displacement blower, centrifugal pump, fan, or other mechanism. The power source 62 as shown is an engine. The power source 62 may rotate a belt 70 which rotates an input shaft 72 of the blower 60. Rotation of the input shaft 72 operates the blower 60, forcing air from the inlet duct 66 into the outlet duct 68.

The inlet duct 66 is in communication with the third conduit 40 (FIGS. 1-2, 4). Thus, operation of the blower displaces air within the vacuum assembly 14. This air displacement allows evacuation of spoils from the tank inlet 26 to the vacuum tank 16.

The outlet duct 68 is interrupted by the silencer 64. Blowers 60 may produce a pressure pulse which increases noise and vibration in the system. The silencer 64 absorbs such pulses to reduce noise and vibration. A silencer may likewise be placed on the inlet duct 66, or on both ducts.

Figure 6:
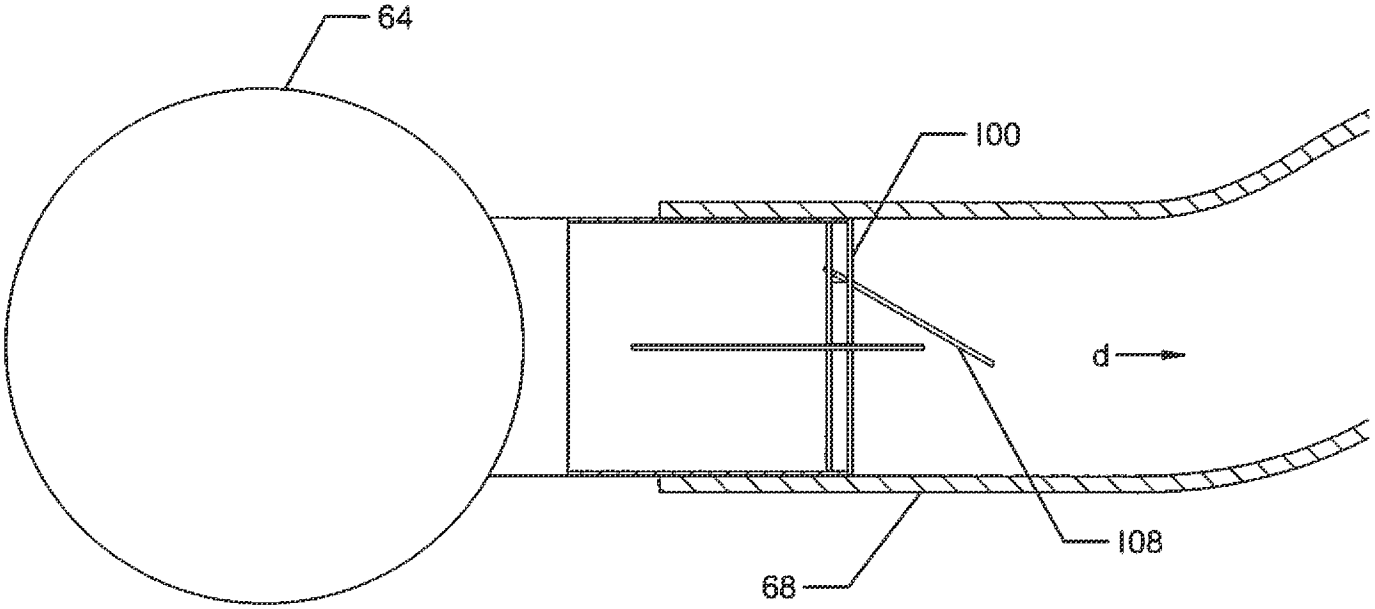
FIG. 6 is a sectional side view of a check valve within a duct.
Figure 7A:
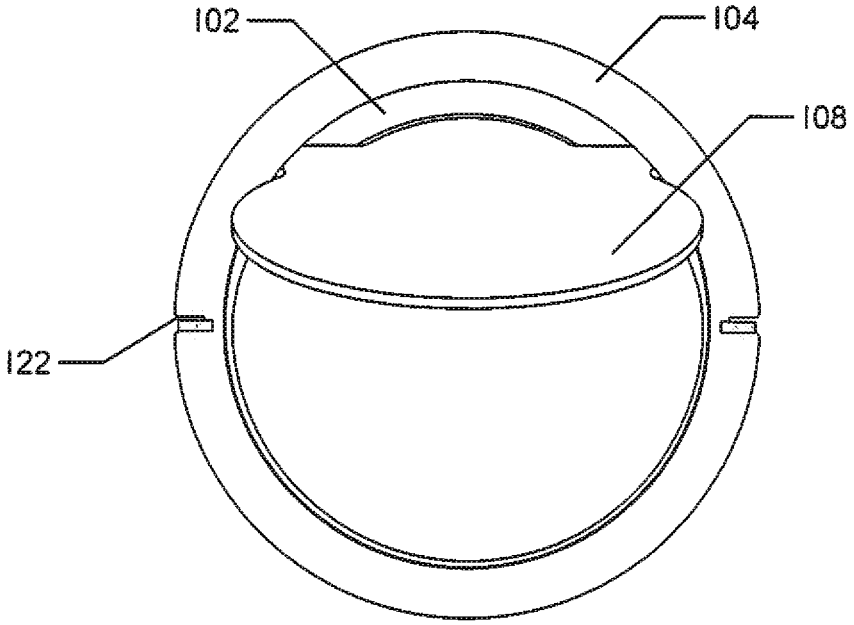
FIG. 7A is a front view of the check valve in an open position.
Figure 7B:
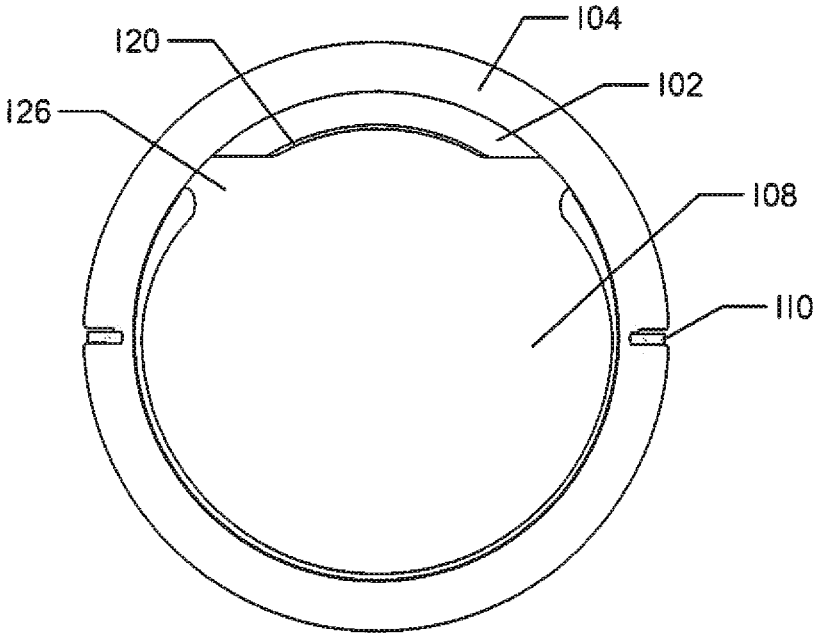
FIG. 7B is a front view of the check valve in a closed position.
Figure 7C:
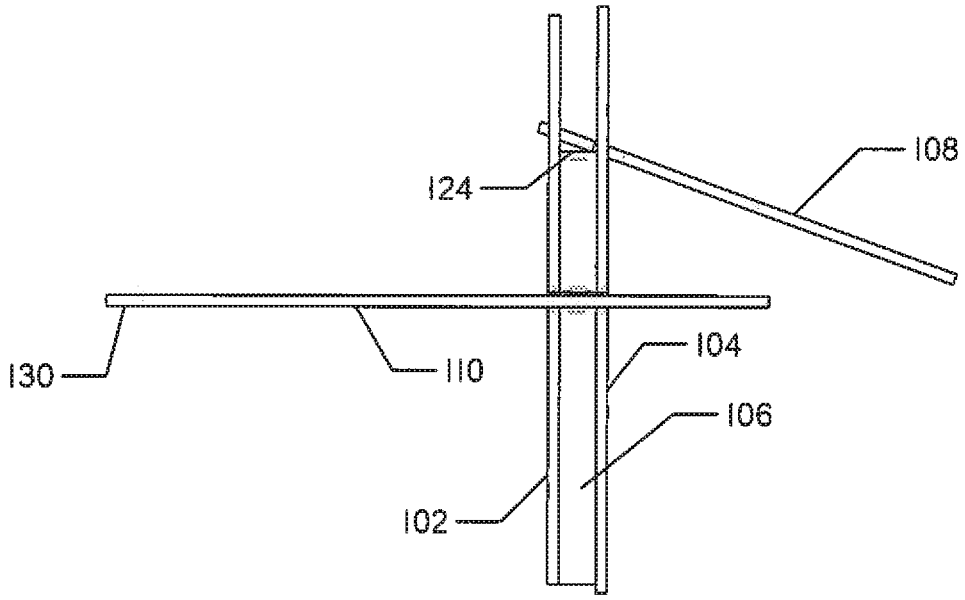
FIG. 7C is a side view of the check valve in an open position.
Figure 7D:
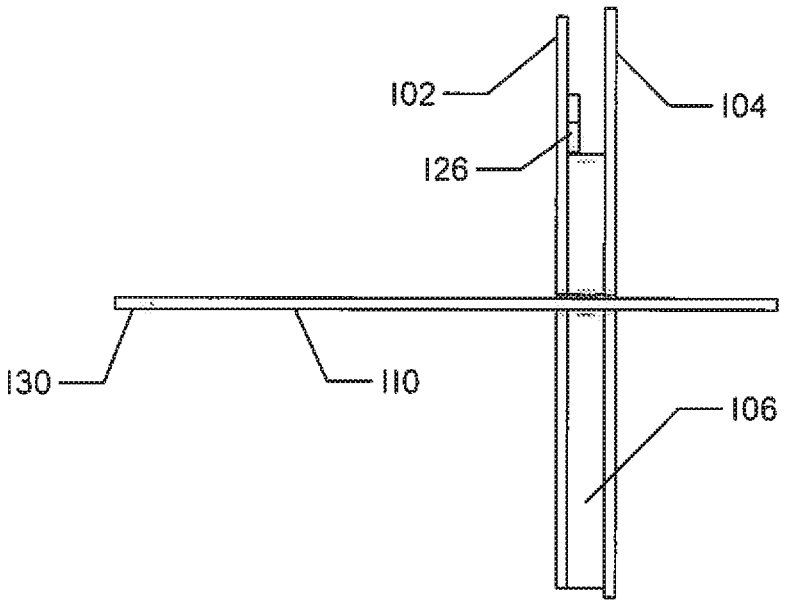
FIG. 7D is a side view of the check valve in a closed position.
Figure 7E:
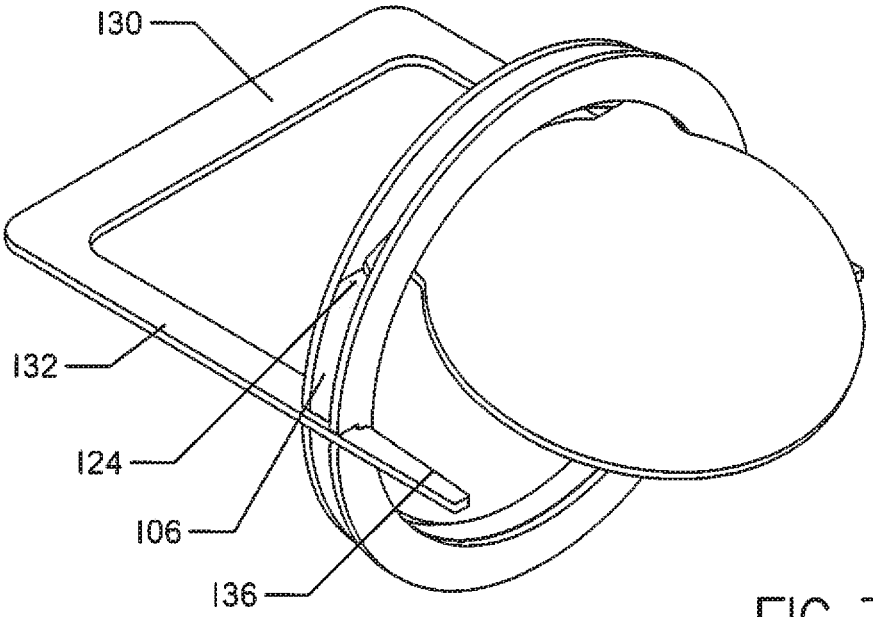
FIG. 7E is a front left top perspective view of the check valve in an open position.
Figure 7F:
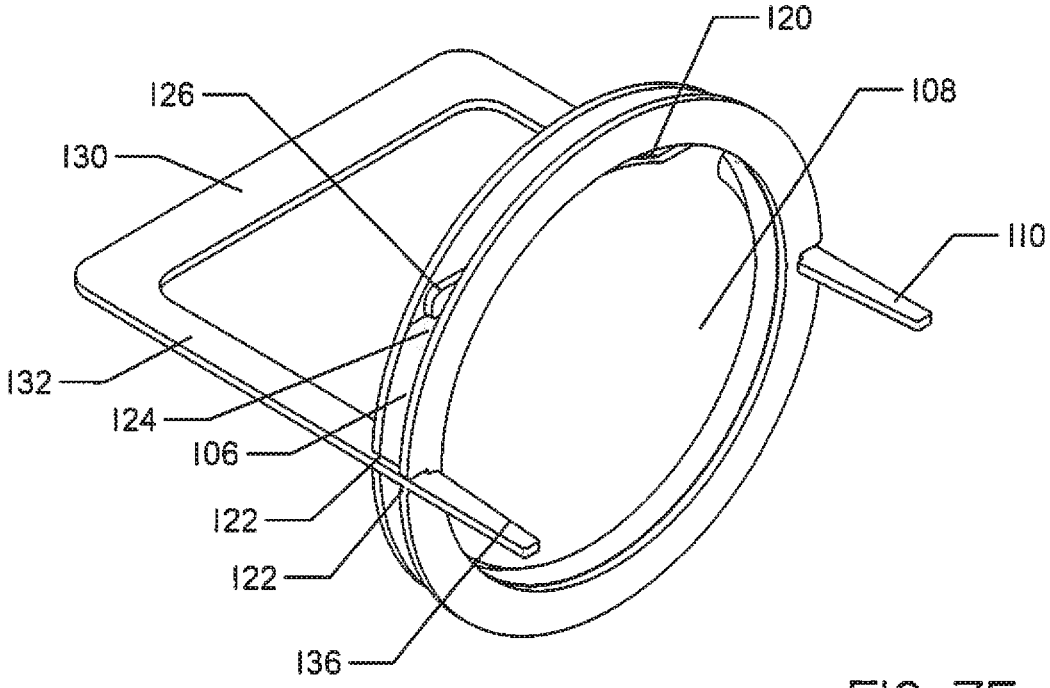
FIG. 7F is a front left top perspective view of the check valve in a closed position.

Air exits the outlet duct 68 to the exhaust 50 (FIGS. 1-2). With reference to FIG. 6, a check valve 100 is disposed within the outlet duct 68 between the silencer 64 and the exhaust 50 (FIGS. 1-2). The check valve 100 is in an open position. The check valve 100 opens when the flow pressure (likely due to operation of the blower) forces air flow in the direction d, causing a flapper disc 108 to rotate upward. The check valve 100 closes in the absence of such pressure and flow. It should be understood that direction d is in the direction of the exhaust 50.

The check valve 100 is not a complete check to counterflow in the direction opposite d. However, the check valve too preferably restricts flow substantially. Therefore counterflow due to low pressure in the vacuum assembly 14, including tank 16 will not rotate elements of blower 60.

With reference again to FIG. 5, it should be understood that rotation of blower 60 in the opposite direction as intended may cause input shaft 72, belt 70, and elements of engine 62 to also rotate "backwards", causing damage to these components. When in the closed position, check valve 100 prevents a high enough flow to cause such rotation.

With reference to FIGS. 7A-7F, one such check valve 100 is shown. The check valve 100 comprises a first retaining ring 102, a second retaining ring 104, a spacer element 106, the flapper disc 108, and a retainer 110. These components 102, 104, 106, 108, 110 are each substantially planar, and therefore may be stamped from sheet metal and assembled to form the check valve 100. The flapper disc 108 is preferably lightweight such that it is easier to open due to flow in the direction d.

Each retaining ring 102, 104 is characterized by an inner circumference and an outer circumference. The inner circumference of the first retaining ring 102 is smaller than the inner circumference of the second retaining ring 104. The flapper disc 108 is sized so that its outer circumference is larger than the inner circumference of the first retaining ring 102, but smaller than the inner circumference of the second retaining ring 104.

In this way, forces on a first side of the flapper disc 108, in the direction d, cause the flapper to "open" away from the first retaining ring 102 through the opening in the second retaining ring 104. Forces on the opposite second side of the flapper disc 108 cause the flapper disc 108 to "close" against the first retaining ring 102. Since the flapper disc 108 is larger than the inner circumference of the first retaining ring 102, the flapper is prevented from opening in the reverse direction. Preferably, a semi-annular clearance 120 is formed between the flapper and the first retaining ring when the flapper is in the closed position allowing some restricted airflow opposite the direction d.

Each retaining ring 102, 104 also has notches 122. Preferably, the notches are formed in the outer circumference of each ring.

The spacer element 106 conforms to a portion of the first and second retaining rings 102, 104, but does not extend about the entire outer or inner circumferences thereof. The spacer element 106 may be a partial ring having a curved outer edge in which notches are formed. Preferably, the spacer element 106 has a thickness wider than the thickness of the retaining rings. A flat surface 124 of the support member 106 supports ears 126 on the flapper disc 108. The ears 126 lock the flapper disc 108 between the rings 102, 104, and provide a hinge for the check valve 100 to open and close.

The retainer no interlocks the first and second retaining rings 102, 104 at their notches 122. The retainer 110 has a cross member 130 and a pair of notched arms 132 extending from the cross member. The end of each arm may have a tapered portion 136 to facilitate sliding the retaining rings 102, 104 and the spacer element 106 along the arms 134 during assembly of the check valve 100. Additionally the end of each arm 132 may bend outward. The outward bend in the arms 132 helps wedge the check valve 100 against the walls of the component, such as the outlet duct 68, in which it is installed.

Alternatively, the check valve 100 may be placed on the inlet duct 66 located on the opposite side of the blower 60 as depicted in FIG. 5. Check valves 100 may be installed in both locations. Further, the flapper disc 108 may be made of materials such as an elastomer or plastic.

The methods and apparatus disclosed herein are exemplary embodiments of the invention and are not meant to be limiting in any way on the scope and uses of the inventions.

The invention claimed is:

1. A vacuum assembly, comprising:
- a vacuum tank;
- an engine assembly comprising:
  - a blower configured to remove air from the vacuum tank;
  - a power source for powering the blower
  - an exhaust port exposed to the atmosphere; and
  - a duct disposed between the blower and the exhaust port and configured to allow air to travel therebetween;
- a check valve disposed in the duct, in which the check valve is characterized by an
  - open position and a closed position, the open position allowing airflow from the blower to the exhaust port and the closed position restricting air flow from the exhaust port to the blower within the duct, the check valve comprising:
    - a first retaining ring having a first inner circumference and a plurality of notches;
    - a second retaining ring having a second inner circumference larger than the inner circumference of the first retaining ring and having a plurality of notches corresponding to the first retaining ring notches;
    - a spacer disposed between the first and second retaining rings:
    - a flapper having a disc-shaped body in which the widest portion of the body is sized larger than the inner circumference of the first retaining ring and smaller than the inner circumference of the second retaining ring and in which the flapper is supported by the spacer;
    - a retainer having a cross member and a pair of notched arms extending from the cross member in which each arm interlockingly receives a pair of the first and second ring notches;
  - wherein the cross member of the retainer is configured to secure the check valve to the duct:
- a first filtration assembly connected to the vacuum tank;
- a second filtration assembly connected to the blower and the first filtration assembly; and
- a conduit extending between the first and second filtration assemblies, the conduit comprising:
  - a first pipe section having an end;
  - a second pipe section having an end sized to be closely received within the first pipe section end in which the ends are removably joined inn threadless connection.

2. The vacuum assembly of claim 1 further comprising a seal.

3. The vacuum assembly of claim 1 further comprising a trailer supporting the vacuum tank.

4. The vacuum assembly of claim 3 further comprising an actuator disposed between the trailer and the vacuum tank, the actuator causing the vacuum tank to tilt such that the first pipe section and second pipe section are disconnected.

5. The vacuum assembly of claim 1 further comprising an actuator movable between a first position and a second position, inn which the ends of the first pipe section and second pipe section are joined in the first position, and are not joined in the second position.

6. The vacuum assembly of claim 5 in which the actuator comprises a hydraulic cylinder.

7. The vacuum assembly of claim 1 in which the end of the second pipe section is characterized by the shape of a conical frustum.

8. The vacuum assembly of claim 1 in which the second pipe section is attached to the first filtration assembly.

9. The vacuum assembly of claim 1 in which the duct is characterized as a first duct and the vacuum assembly further comprising:
- a second duct disposed between the blower and the second filtration assembly; and
- a check valve disposed in the second duct;
- in which the check valve is characterized by an open position and a closed position, the open position allowing air flow from the second filtration assembly to the blower and the closed position restricting air flow from the blower to the second filtration assembly within the duct.

10. The vacuum assembly of claim 1 in which a semi-annular orifice is formed between the flapper body and the second retaining ring when the check valve is in the closed position.

11. The vacuum assembly of claim 1 in which the flapper is actuated from the closed position to the open position by air flow from the blower to the exhaust port.

12. The vacuum assembly of claim 1 in which the flapper comprises a pair of ears extending laterally from the body and contacting the support member.

13. The vacuum assembly of claim 1 further comprising a silencer disposed between the blower and the exhaust port.

14. The vacuum assembly of claim 1 in which the blower comprises a centrifugal pump.

15. A vacuum assembly comprising:
- a vacuum tank;
- a blower in communication with the vacuum tank;
- an exhaust port;
- a duct disposed between the blower and the exhaust port; and
- a check valve disposed in the duct, the check valve comprising:
  - a first retaining ring having a first inner circumference and a plurality of notches;
  - a second retaining ring having a second inner circumference larger than the inner circumference of the first retaining ring and having a plurality of notches corresponding to the first retaining ring notches;
  - a spacer disposed between the first and second retaining rings;
  - a flapper having a disc-shaped body in which the widest portion of the body is sized larger than the inner circumference of the first retaining ring and smaller than the inner circumference of the second retaining ring and in which the flapper is supported by the spacer;
  - a retainer having a cross member and a pair of notched arms extending from the cross member in which each arm interlockingly receives a pair of the first and second ring notches;

wherein the cross member of the retainer is configured to secure the check valve to the duct.

16. The vacuum assembly of claim 15 further comprising:

a first filtration assembly connected to the vacuum tank;

a second filtration assembly connected to the blower and the first filtration assembly; and a conduit extending between the first and second filtration assemblies.

17. The vacuum system of claim 16 wherein the conduit further comprises:

a first pipe section having an end;

a second pipe section having an end sized to be closely received within the first pipe section end in which the ends are removably joined in threadless connection.

18. The vacuum system of claim 17 in which the end of the second pipe section is characterized by the shape of a conical frustum.

* * * * *